US010082273B2

(12) United States Patent
Hsu

(10) Patent No.: US 10,082,273 B2
(45) Date of Patent: Sep. 25, 2018

(54) LED KEROSENE LAMP

(71) Applicant: Dong Guan Bright Yinhuey Lighting Co., Ltd. China, Guang Dong (CN)

(72) Inventor: Kevin Hsu, Taichung (TW)

(73) Assignee: Dong Guan Bright Yinhuey Lighting Co., Ltd. China, Guang Dong (CN)

( * ) Notice: Subject to any disclaimer, the term of this patent is extended or adjusted under 35 U.S.C. 154(b) by 94 days.

(21) Appl. No.: 15/414,705

(22) Filed: Jan. 25, 2017

(65) Prior Publication Data

US 2018/0209611 A1 Jul. 26, 2018

(51) Int. Cl.

| | |
|---|---|
| ***F21V 14/02*** | (2006.01) |
| ***F21V 3/02*** | (2006.01) |
| ***H05B 33/08*** | (2006.01) |
| ***F21V 15/01*** | (2006.01) |
| ***F21L 4/08*** | (2006.01) |
| ***H04R 1/02*** | (2006.01) |
| ***F21K 9/65*** | (2016.01) |
| *F21Y 115/10* | (2016.01) |

(52) U.S. Cl.

CPC ..... *F21V 14/02* (2013.01); *F21K 9/65* (2016.08); *F21L 4/08* (2013.01); *F21V 3/02* (2013.01); *F21V 14/025* (2013.01); *F21V 15/01* (2013.01); *H04R 1/028* (2013.01); *H05B 33/0845* (2013.01); *F21Y 2115/10* (2016.08)

(58) Field of Classification Search

CPC ... F21V 14/02; F21V 14/025; H05B 33/0845; F21K 9/00; F21K 9/65; F21W 2131/00; F21W 2131/10; F21W 2131/30

See application file for complete search history.

(56) References Cited

U.S. PATENT DOCUMENTS

| | | | | |
|---|---|---|---|---|
| 6,877,876 | B1 * | 4/2005 | Steinhilber | F21V 14/025 362/187 |
| 9,709,247 | B2 * | 7/2017 | Man | F21V 14/025 |
| 2015/0300581 | A1 * | 10/2015 | Huang | F21L 4/00 362/86 |
| 2015/0369432 | A1 * | 12/2015 | Li | F21S 6/001 362/249.02 |
| 2016/0258600 | A1 * | 9/2016 | Jain | F21V 14/02 |
| 2017/0171932 | A1 * | 6/2017 | Puvanakijjakorn | F21V 29/70 |
| 2018/0094794 | A1 * | 4/2018 | Datta | F21V 14/02 |

* cited by examiner

*Primary Examiner* — Anh Mai
*Assistant Examiner* — Michael Chiang
(74) *Attorney, Agent, or Firm* — Alan D. Kamrath; Kamrath IP Lawfirm, P.A.

(57) ABSTRACT

An LED kerosene lamp includes a holder, a transmission mechanism mounted on the holder, a rotary knob connected with and driving the transmission mechanism, a lifting module connected with and driven by the transmission mechanism, an LED module mounted on the lifting module, a potentiometer connected with the transmission mechanism, and a lampshade covering the LED module. When the rotary knob is rotated in a first direction, the transmission mechanism drives the lifting module which moves the LED module upward, while the transmission mechanism drives the potentiometer which increases the brightness of the LED module. When the rotary knob is rotated in a second direction, the transmission mechanism drives the lifting module which moves the LED module downward, while the transmission mechanism drives the potentiometer which decreases the brightness of the LED module.

10 Claims, 5 Drawing Sheets

LED KEROSENE LAMP

BACKGROUND OF THE INVENTION

1. Field of the Invention

The present invention relates to a lamp and, more particularly, to an LED (light emitting diode) kerosene lamp.

2. Description of the Related Art

A conventional LED lamp is used safely, has an environmentally friendly function, has a greater longevity, consumes smaller energy and has a higher brightness. However, the conventional LED lamp needs to provide a control switch to turn on or off the light, thereby causing inconvenience to the user. In addition, the brightness of the conventional LED lamp cannot be regulated, thereby decreasing the aesthetic quality. Further, the light of the conventional LED lamp is too bright, thereby decreasing the lifetime of the conventional LED lamp. A conventional kerosene lamp has an outstanding appearance to enhance the indoor atmosphere and to provide an elegant sensation to the user. However, the brightness of the conventional kerosene lamp is too low and cannot be regulated.

BRIEF SUMMARY OF THE INVENTION

In accordance with the present invention, there is provided an LED kerosene lamp comprising a holder, a transmission mechanism mounted on the holder, a rotary knob mounted on the holder and connected with the transmission mechanism to drive the transmission mechanism, a lifting module mounted on the holder and connected with and driven by the transmission mechanism, an LED module mounted on the lifting module, a potentiometer mounted on the holder and connected with the transmission mechanism, and a lampshade mounted on the holder and covering the LED module. The potentiometer is electrically connected with the LED module to control an electric current passing through the LED module. In practice, when the rotary knob is rotated in a first direction, the transmission mechanism drives the lifting module which drives and moves the LED module upward, while the transmission mechanism drives the potentiometer which increases a brightness of the LED module. On the contrary, when the rotary knob is rotated in a second direction, the transmission mechanism drives the lifting module which drives and moves the LED module downward, while the transmission mechanism drives the potentiometer which decreases the brightness of the LED module.

According to the primary advantage of the present invention, the LED module is lifted or lowered by cooperation of the rotary knob, the transmission mechanism and the lifting module, while the brightness of the LED module is regulated simultaneously by operation of the potentiometer, thereby enhancing the versatility and lifetime of the LED module.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
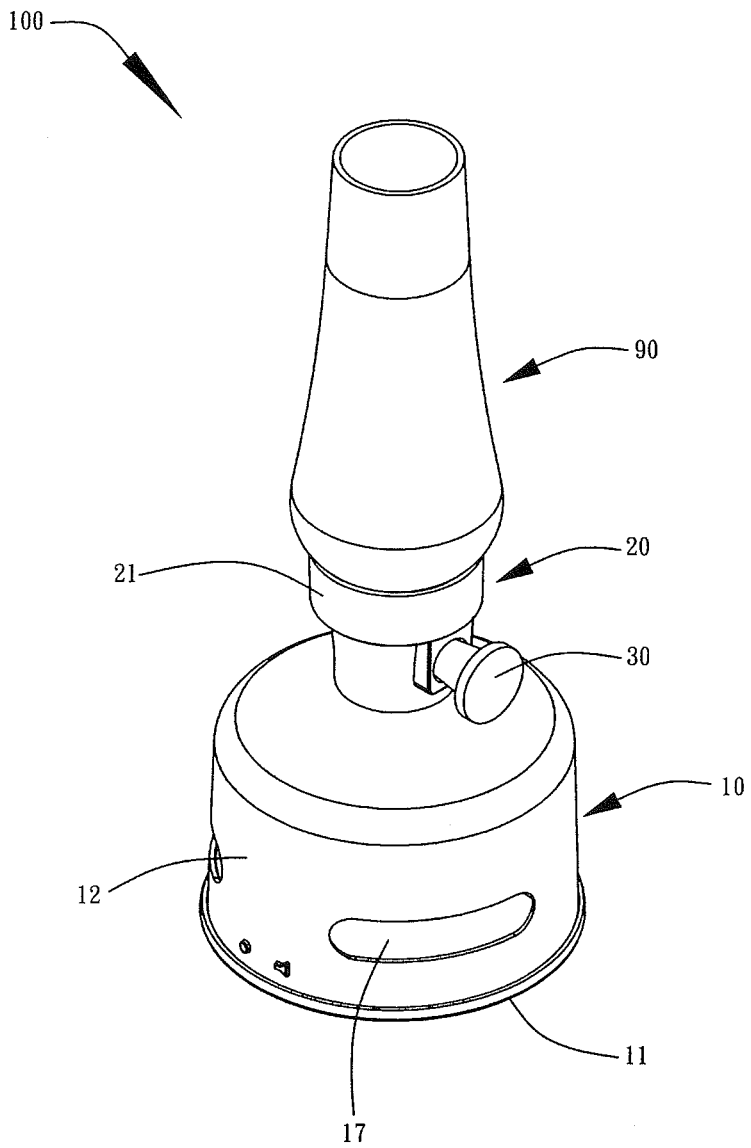
FIG. 1 is a perspective view of an LED kerosene lamp in accordance with the preferred embodiment of the present invention.
Figure 2:
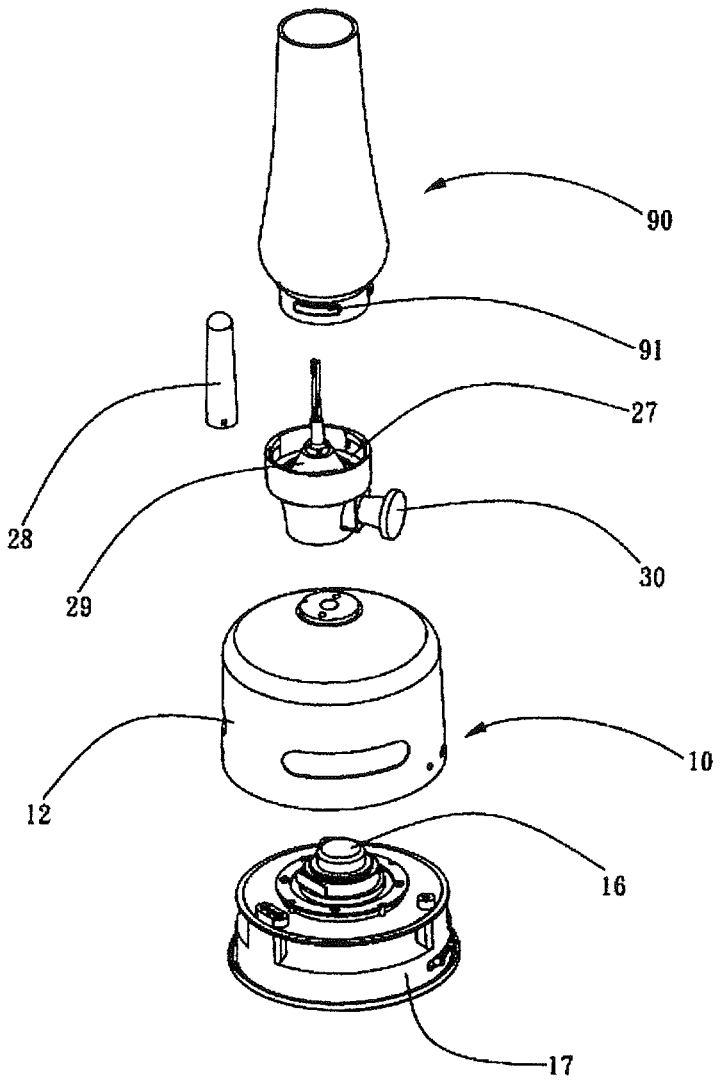
FIG. 2 is an exploded perspective view of the LED kerosene lamp in accordance with the preferred embodiment of the present invention.
Figure 3:
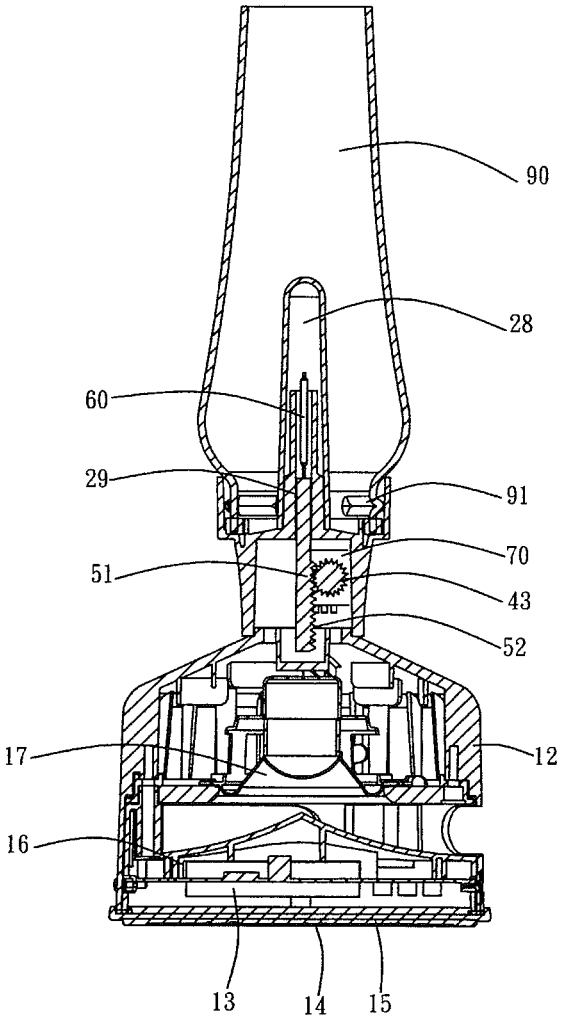
FIG. 3 is a cross-sectional view of the LED kerosene lamp as shown in FIG. 1.
Figure 4:
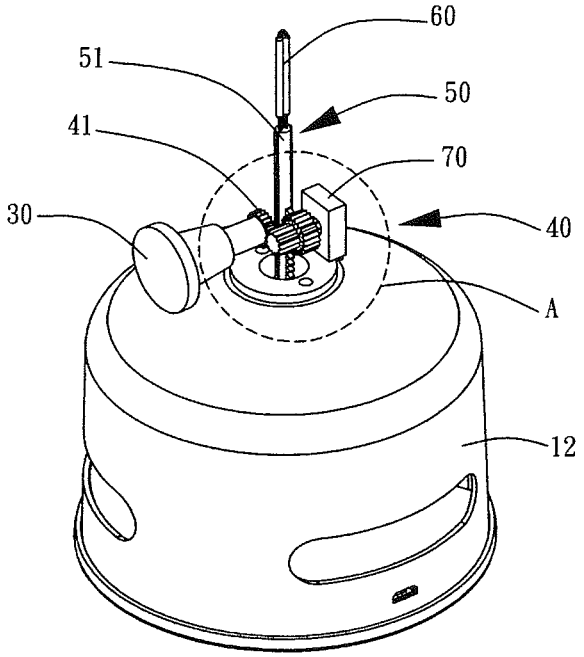
FIG. 4 is a partially perspective view of the LED kerosene lamp in accordance with the preferred embodiment of the present invention.
Figure 5:
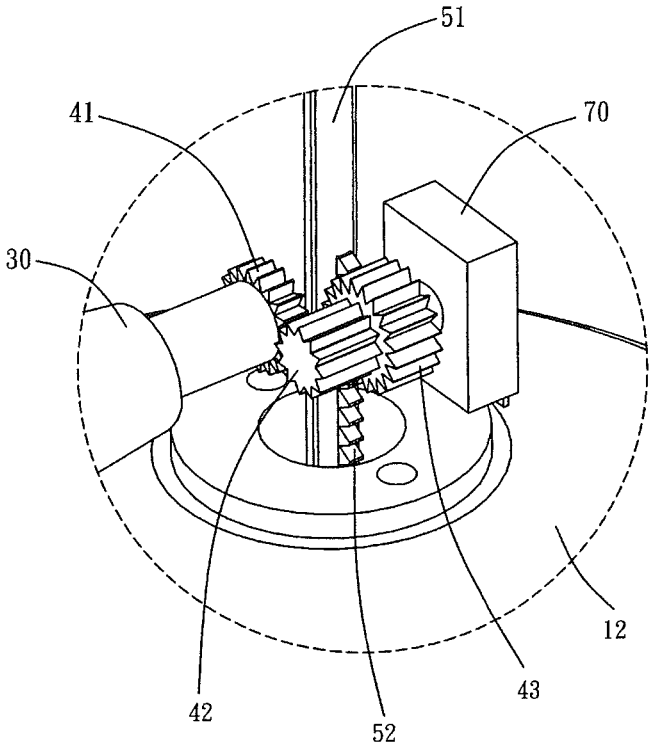
FIG. 5 is a locally enlarged view of the LED kerosene lamp taken along circle "A" as shown in FIG. 4.

Referring to FIGS. 1-5, an LED kerosene lamp 100 in accordance with the preferred embodiment of the present invention comprises a holder 20, a transmission mechanism 40 mounted on the holder 20, a rotary knob 30 mounted on the holder 20 and connected with the transmission mechanism 40 to drive the transmission mechanism 40, a lifting module 50 mounted on the holder 20 and connected with and driven by the transmission mechanism 40, an LED module 60 mounted on the lifting module 50, a potentiometer 70 mounted on the holder 20 and connected with the transmission mechanism 40, and a lampshade 90 mounted on the holder 20 and covering the LED module 60. The potentiometer 70 is electrically connected with the LED module 60 to control an electric current passing through the LED module 60. The rotary knob 30 includes a rotary handle protruding from the holder 20 and a rotation shaft having a first end connected with the rotary handle and a second end extending into the holder 20 and connected with the transmission mechanism 40. The lifting module 50 engages the transmission mechanism 40 and drives the LED module 60 to move upward and downward in the lampshade 90.

In practice, when the rotary knob 30 is rotated in a first (or clockwise) direction, the transmission mechanism 40 drives the lifting module 50 which drives and moves the LED module 60 upward, while the transmission mechanism 40 drives the potentiometer 70 which increases a brightness of the LED module 60. On the contrary, when the rotary knob 30 is rotated in a second (or counterclockwise) direction opposite to the first direction, the transmission mechanism 40 drives the lifting module 50 which drives and moves the LED module 60 downward, while the transmission mechanism 40 drives the potentiometer 70 which decreases the brightness of the LED module 60. Thus, the LED module 60 is lifted or lowered by cooperation of the transmission mechanism 40 and the lifting module 50, while the brightness of the LED module 60 is regulated simultaneously by operation of the potentiometer 70.

In the preferred embodiment of the present invention, the transmission mechanism 40 is a gear set and includes a driving gear 41 mounted on the rotation shaft of the rotary knob 30, a transmission gear 42 meshing with the driving gear 41, and a driven gear 43 connected with the transmission gear 42. The driving gear 41 includes a plurality of driving teeth distributed evenly on a periphery of the driving gear 41. The transmission gear 42 includes a plurality of transmission teeth distributed evenly on a periphery of the transmission gear 42. The transmission gear 42 has a plurality of engaging portions formed between the transmission teeth and protruding radially from the transmission gear 42. The engaging portions of the transmission gear 42 mesh with the driving teeth of the driving gear 41. The driven gear 43 includes a plurality of outer teeth distributed evenly on a periphery of the driven gear 43 and a plurality of inner teeth distributed evenly on an inner edge of the driven gear 43.

The inner teeth of the driven gear 43 form an inner toothed portion engaging a middle position of the engaging portions of the transmission gear 42. Thus, when the transmission gear 42 is rotated, the driven gear 43 is also driven by the transmission gear 42 to rotate simultaneously.

In the preferred embodiment of the present invention, the lifting module 50 includes a lifting plate 51 movably mounted on the holder 20 and connected with the LED module 60, and a toothed rack 52 secured on the lifting plate 51 and meshing with the driven gear 43. The lifting plate 51 has a top provided with a fixing portion for locking the LED module 60. The toothed rack 52 forms a downward inclined toothed portion engaging the outer teeth of the driven gear 43. Thus, the transmission mechanism 40 drives the lifting module 50 to move upward and downward in the holder 20, and the lifting module 50 then drives the LED module 60 to move upward and downward in the lampshade 90. The LED module 60 includes a plurality of LED cores which are arranged in a rectangular manner to facilitate upward and downward movement of the LED module 60 in the lampshade 90.

In the preferred embodiment of the present invention, the potentiometer 70 is secured in the holder 20 and is provided with a connecting portion connected with the transmission gear 42 of the transmission mechanism 40. Thus, when the transmission gear 42 of the transmission mechanism 40 is rotated, the transmission gear 42 of the transmission mechanism 40 activates the potentiometer 70 to change the resistance value in the potentiometer 70, and to change the voltage and current value of the power supply circuit.

In the preferred embodiment of the present invention, the transmission mechanism 40 and the lifting module 50 are made of insulating material. Preferably, the transmission mechanism 40 and the lifting module 50 are made of a plastic shell.

In the preferred embodiment of the present invention, the holder 20 has an end provided with a locking portion 21. A guide track 29 is provided on the locking portion 21 of the holder 20 and mounted on the lifting module 50, and the lifting plate 51 of the lifting module 50 is movable in the guide track 29, so that the lifting module 50 is movable upward and downward in the holder 20. A protective member 28 is locked on the guide track 29 and covers the LED module 60 so as to protect the LED module 60. Preferably, the protective member 28 is made of transparent PC material. Thus, the light of the LED module 60 irradiates outward from the protective member 28. A lampshade bushing 27 is mounted in the locking portion 21 of the holder 20 and located between the lampshade 90 and the holder 20. Preferably, the lampshade bushing 27 is made of a silica gel.

In the preferred embodiment of the present invention, the lampshade 90 has a lower end provided with a rotation strip 91 locked on the locking portion 21 of the holder 20, so that the lampshade 90 and the holder 20 rotate. The lampshade bushing 27 is located between the lampshade 90 and the holder 20 to prevent the lampshade 90 and the holder 20 from hitting each other. The lampshade 90 has a substantially cylindrical shape and is tapered from bottom to top, so that the light of the LED module 60 is focused gradually from bottom to top, so as to increase the scattering scope of the light of the LED module 60. The lampshade 90 has an open top to provide a heat dissipation function to the LED module 60. Preferably, the lampshade 90 is made of transparent material, such as glass or PC material.

In the preferred embodiment of the present invention, the LED kerosene lamp 100 further comprises a base 10 mounted on a bottom of the holder 20, an electric power system 13 mounted in the base 10, a stand 17 mounted in the base 10, and a speaker 16 mounted on and supported by the stand 17. The base 10 includes a bottom cap 11 and a top cover 12 mounted on the bottom cap 11. The bottom cap 11 of the base 10 is provided with an anti-skid rubber 14 and an iron sheet 15. The anti-skid rubber 14 and the iron sheet 15 are used to fix the base 10. The stand 17 is provided with a plurality of support posts for supporting and fixing the speaker 16. The electric power system 13 includes a circuit board, a power supply, a bluetooth receiver, and a USB (universal serial bus) interface. The circuit board of the electric power system 13 is provided with a plurality of control buttons for controlling the LED module 60 and the speaker 16. The USB interface of the electric power system 13 provides a charging function to the power supply.

Accordingly, the LED module 60 is lifted or lowered by cooperation of the rotary knob 30, the transmission mechanism 40 and the lifting module 50, while the brightness of the LED module 60 is regulated simultaneously by operation of the potentiometer 70, thereby enhancing the versatility and lifetime of the LED module 60. In addition, the LED kerosene lamp 100 has an outstanding appearance, thereby enhancing the aesthetic quality of the LED kerosene lamp 100. Further, the LED kerosene lamp 100 has a simplified construction, thereby decreasing the fabrication cost of the LED kerosene lamp 100. Further, the LED kerosene lamp 100 is carried and operated easily and conveniently.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. An LED kerosene lamp comprising:

a holder;

a transmission mechanism mounted on the holder;

a rotary knob mounted on the holder and connected with the transmission mechanism to drive the transmission mechanism;

a lifting module mounted on the holder and connected with and driven by the transmission mechanism;

an LED module mounted on the lifting module;

a potentiometer mounted on the holder and connected with the transmission mechanism; and a lampshade mounted on the holder and covering the LED module;

wherein:

the potentiometer is electrically connected with the LED module to control an electric current passing through the LED module;

when the rotary knob is rotated in a first direction, the transmission mechanism drives the lifting module which drives and moves the LED module upward, while the transmission mechanism drives the potentiometer which increases a brightness of the LED module; and when the rotary knob is rotated in a second direction, the transmission mechanism drives the lifting module which drives and moves the LED module downward, while the transmission mechanism drives the potentiometer which decreases the brightness of the LED module.

2. The LED kerosene lamp of claim 1, wherein:
the transmission mechanism is a gear set and includes:
a driving gear mounted on the rotation shaft of the rotary knob;
a transmission gear meshing with the driving gear; and
a driven gear connected with the transmission gear;
the driving gear includes a plurality of driving teeth distributed evenly on a periphery of the driving gear;
the transmission gear includes a plurality of transmission teeth distributed evenly on a periphery of the transmission gear;
the transmission gear has a plurality of engaging portions formed between the transmission teeth and protruding radially from the transmission gear; and
the engaging portions of the transmission gear mesh with the driving teeth of the driving gear.

3. The LED kerosene lamp of claim 2, wherein:
the driven gear includes a plurality of outer teeth distributed evenly on a periphery of the driven gear and a plurality of inner teeth distributed evenly on an inner edge of the driven gear; and
the inner teeth of the driven gear form an inner toothed portion engaging a middle position of the engaging portions of the transmission gear.

4. The LED kerosene lamp of claim 3, wherein:
the lifting module includes:
a lifting plate movably mounted on the holder and connected with the LED module; and
a toothed rack secured on the lifting plate and meshing with the driven gear;
the lifting plate has a top provided with a fixing portion for locking the LED module; and
the toothed rack forms a downward inclined toothed portion engaging the outer teeth of the driven gear.

5. The LED kerosene lamp of claim 2, wherein the potentiometer is provided with a connecting portion connected with the transmission gear of the transmission mechanism.

6. The LED kerosene lamp of claim 1, wherein the transmission mechanism and the lifting module are made of insulating material.

7. The LED kerosene lamp of claim 1, wherein:
the holder has an end provided with a locking portion;
a guide track is provided on the locking portion of the holder;
the lifting plate of the lifting module is movable in the guide track;
a protective member is locked on the guide track and covers the LED module; and
a lampshade bushing is mounted in the locking portion of the holder and located between the lampshade and the holder.

8. The LED kerosene lamp of claim 7, wherein the lampshade has a lower end provided with a rotation strip locked on the locking portion of the holder, so that the lampshade and the holder rotate.

9. The LED kerosene lamp of claim 1, further comprising:
a base mounted on a bottom of the holder;
an electric power system mounted in the base;
a stand mounted in the base; and
a speaker mounted on and supported by the stand;
wherein:
the base includes a bottom cap and a top cover mounted on the bottom cap;
the bottom cap of the base is provided with an anti-skid rubber and an iron sheet;
the anti-skid rubber and the iron sheet are used to fix the base; and
the stand is provided with a plurality of support posts for supporting and fixing the speaker.

10. The LED kerosene lamp of claim 9, wherein:
the electric power system includes a circuit board, a power supply, a bluetooth receiver, and a USB (universal serial bus) interface;
the circuit board of the electric power system is provided with a plurality of control buttons for controlling the LED module and the speaker; and
the USB interface of the electric power system provides a charging function to the power supply.

* * * * *